US010571120B2

(12) United States Patent
Asai

(10) Patent No.: US 10,571,120 B2
(45) Date of Patent: Feb. 25, 2020

(54) COMBUSTION APPARATUS

(71) Applicant: RINNAI CORPORATION, Aichi (JP)

(72) Inventor: Yusuke Asai, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 139 days.

(21) Appl. No.: 15/866,844

(22) Filed: Jan. 10, 2018

(65) Prior Publication Data

US 2018/0209640 A1 Jul. 26, 2018

(30) Foreign Application Priority Data

Jan. 24, 2017 (JP) ..... 2017-010041

(51) Int. Cl.
*F23D 14/04* (2006.01)
*F23D 14/58* (2006.01)
*F23C 6/04* (2006.01)

(52) U.S. Cl.
CPC ..... *F23D 14/045* (2013.01); *F23C 6/045* (2013.01); *F23D 14/583* (2013.01); *F23C 2201/20* (2013.01); *F23C 2900/06041* (2013.01); *F23D 2900/00003* (2013.01)

(58) Field of Classification Search
CPC ..... F23D 14/045; F23D 14/583; F23C 6/045
USPC ..... 431/354
See application file for complete search history.

(56) References Cited

U.S. PATENT DOCUMENTS 1,399,919 A * 12/1921 Bacon ..... F23C 1/04 110/262
10,006,660 B2 * 6/2018 Ojiro ..... F24H 1/30
2008/0131828 A1 * 6/2008 Ojiro ..... F23D 14/14 431/350
2011/0297059 A1 * 12/2011 Shimizu ..... F23D 14/045 110/299
2016/0377282 A1 * 12/2016 Sugioka ..... F23D 14/02 431/353

FOREIGN PATENT DOCUMENTS

EP 0534554 A2 * 3/1993 ..... F23D 14/045
EP 3470750 A1 * 4/2019 ..... F24H 1/40
JP 20112-52671 A 12/2011

* cited by examiner

*Primary Examiner* — Avinash A Savani
*Assistant Examiner* — Aaron H Heyamoto
(74) *Attorney, Agent, or Firm* — Cermak Nakajima & McGowan LLP; Tomoko Nakajima

(57) ABSTRACT

In a combustion apparatus provided with: a combustion box having a connection flange part for connecting a heat exchanger to an upper end of the combustion box; a partition plate disposed inside the combustion box for partitioning space inside the combustion box into a combustion chamber and an air supply chamber which lies under the combustion chamber; and a plurality of laterally arrayed burners which are elongated longitudinally, the internal volume of the combustion box is increased without increasing a height dimension or without enlarging the connection flange part, thereby restraining the occurrence of resonance sounds. A drawn part projecting laterally outward of the combustion box is provided in such a portion of each side-plate part as is above the partition plate, over a predetermined range in the vertical and longitudinal directions. An upper side of the drawn part is preferably positioned below the upper end of the burners, and is preferably parallel with the upper end of the burners.

3 Claims, 5 Drawing Sheets

COMBUSTION APPARATUS

BACKGROUND OF THE INVENTION

1. Technical Field

The present invention relates to a combustion apparatus provided with a combustion box which has, on an upper end thereof, a connection flange part for connecting thereto a heat exchanger.

2. Background Art

As this kind of combustion apparatus, there is known one comprising: a partition plate inside a combustion box in order to partition space inside the combustion box into a combustion chamber and an air supply chamber which lies under the combustion chamber; and a plurality of burners which are laterally arrayed, each of the burners being longitudinally elongated with flame holes on an upper end thereof such that air can be supplied from the air supply chamber to the combustion chamber through a multiplicity of distribution holes formed in the partition plate (see, e.g., JP-A-2011-252671).

By the way, in this kind of combustion apparatus provided with the combustion box, there are cases in which Helmholtz type resonant frequency may give rise to larger resonance sounds in consonance with a frequency of the combustion vibrations. Here, the Helmholtz type resonance frequency lowers by increasing an internal volume of the combustion box. Therefore, by increasing the internal volume of the combustion box to thereby make the Helmholtz type resonance frequency lower than the frequency of the combustion vibrations, the occurrence of the resonance sounds can be restrained.

However, if the height dimension of the combustion box is increased in order to increase the internal volume of the combustion box, the distance between the heat exchanger and the burners will become larger, resulting in a poorer thermal efficiency. In addition, if the lateral dimension or the longitudinal dimension of the entire combustion box is increased, the connection flange part on the upper end of the combustion box will also become larger. It therefore becomes necessary to modify the heat exchanger that is connected to the connection flange part. For that reason, it has currently been not practiced to increase the internal volume of the combustion box in order to restrain the occurrence of the resonance sound

SUMMARY

Problems that the Invention is to Solve

In view of the above-mentioned points, this invention has a problem of providing a combustion apparatus in which the internal volume of the combustion box is increased in order to restrain the resonance sound, without the necessity of increasing the dimension in height of the combustion box, or of increasing the connection flange part on the upper end of the combustion box.

Means to Solve the Problems

In order to solve the above-mentioned problem, this invention is a combustion apparatus comprising: a combustion box having, on an upper end thereof, a connection flange part for connecting thereto a heat exchanger; a partition plate inside the combustion box in order to partition space therein into a combustion chamber and an air supply chamber which lies under the combustion chamber; a plurality of burners which are laterally arrayed in the combustion chamber, each of the burners being longitudinally elongated with flame holes on an upper end thereof such that air can be supplied from the air supply chamber to the combustion chamber through a multiplicity of distribution holes formed in the partition plate. In the above-arrangement, a drawn part is disposed in a portion, above the partition plate, of a side-plate part on each lateral side of the combustion box, the drawn part being projecting laterally outward of the side-plate part over a predetermined range in the vertical and longitudinal directions (note: the expression "drawn" as in "drawn part" is used in the meaning of metal working such as processing of thin metal plate).

According to this invention, the internal volume of the combustion box increases by the amount of the drawn part and, as a result, the resonance sound can be restrained from occurring. In addition, according to this invention, there is no need of increasing the dimension in height of the combustion box. Therefore, no such disadvantage will occur as lowering in the thermal efficiency due to an increase in distance between the heat exchanger and the burners. In addition, since there is no need of enlarging the connection flange part on the upper end of the combustion box, the heat exchanger may remain as it is without modifications. Still furthermore, since the portion in which the drawn part is disposed is above the partition plate, the drawn part will give no hindrance to disposing the partition plate, as will be described hereinafter.

By the way, the side-plate part is arranged to be cooled by an upward air flow along the internal surface of the side-plate part of the combustion box to prevent overheating of the side-plate part. However, at an upper side of the drawn part the air which has flown upward along the internal surface of the drawn part will be given a directional component which is directed laterally inward. Therefore, in the side-plate portion in the neighborhood of the upper side of the drawn part, the air flow will be off from the internal surface of the side-plate part, thereby resulting in lowering of the capacity of cooling the side-plate part by the air flow. At this time, if the upper side of the drawn part is positioned above the upper end of the burners, the side-plate portion in the neighborhood of the upper side of the drawn part, at which the cooling capacity by the air flow lowers, will receive heat from the flames of the burners. As a result, this side-plate portion is likely to be overheated.

As a solution, in this invention, the upper side of the drawn part is preferably positioned below the upper end of the burners. According to this arrangement, the side-plate portion in the neighborhood of the upper side of the drawn part, at which the capacity of cooling by the air flow lowers, will no more receive much heat from the flames of the burners. Overheating of this side-plate portion can thus be suppressed.

In this case, the upper side of the drawn part shall preferably be positioned in parallel with the upper end of the burners. According to this arrangement, the manner of flow of the secondary air toward the flames of the burners adjoining the side-plate part becomes uniform over the entire length of the burners, thereby preventing the occurrence of uneven combustion.

PREFERRED EMBODIMENTS FOR CARRYING OUT THE INVENTION

Figure 1:
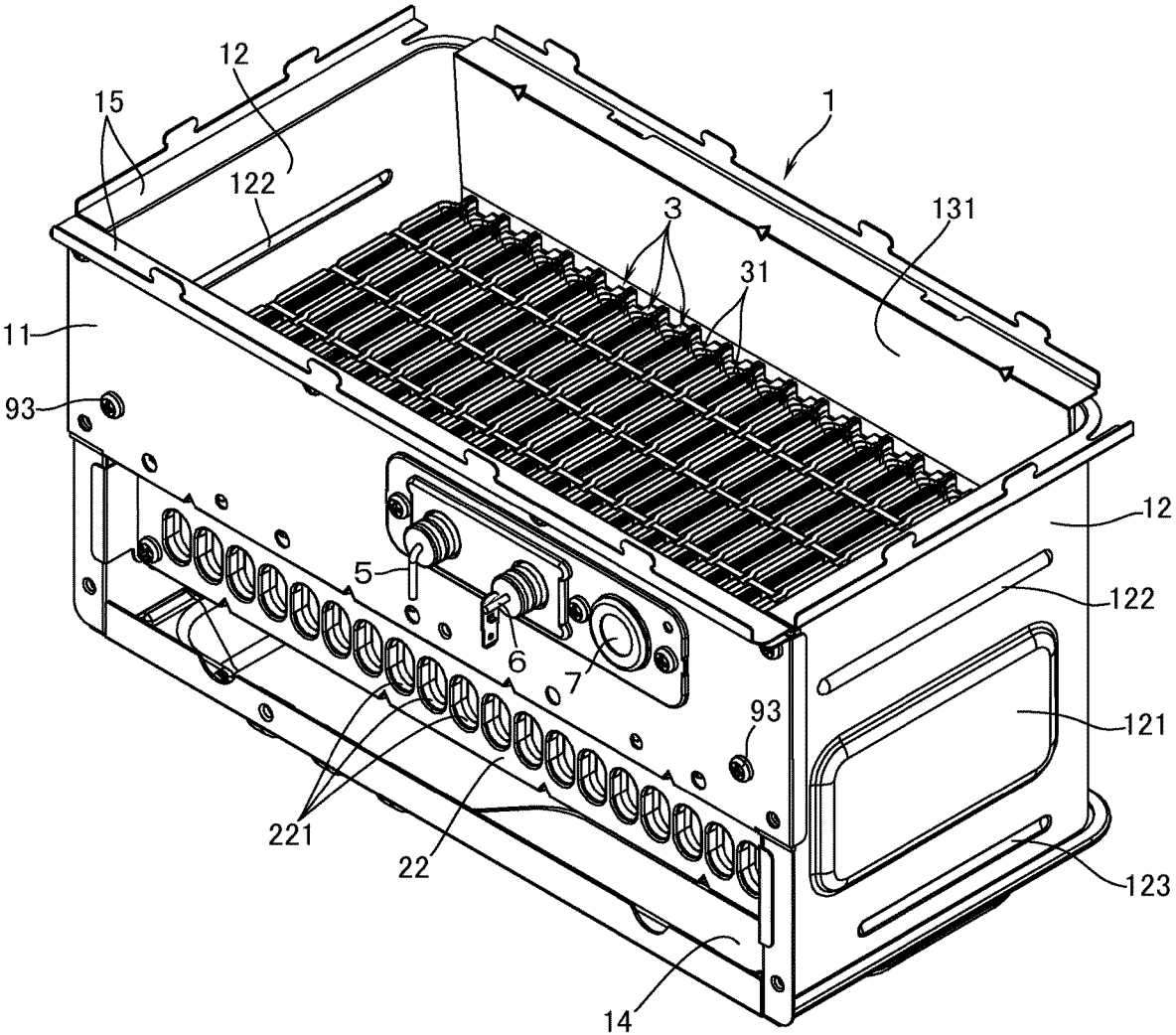
FIG. 1 is a perspective view of a combustion apparatus according to an embodiment of this invention.
Figure 2:
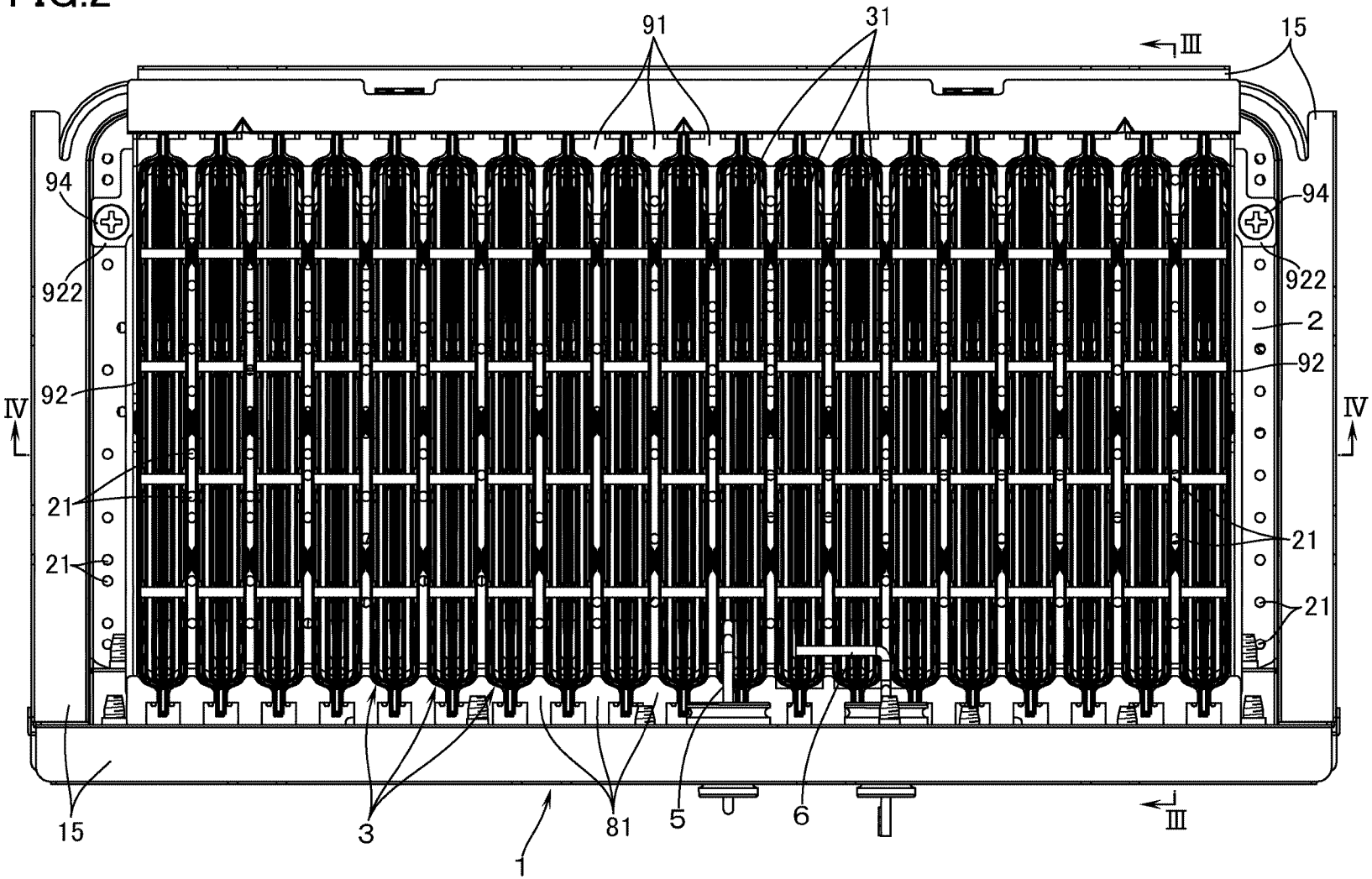
FIG. 2 is a plan view of the combustion apparatus according to the embodiment.
Figure 3:
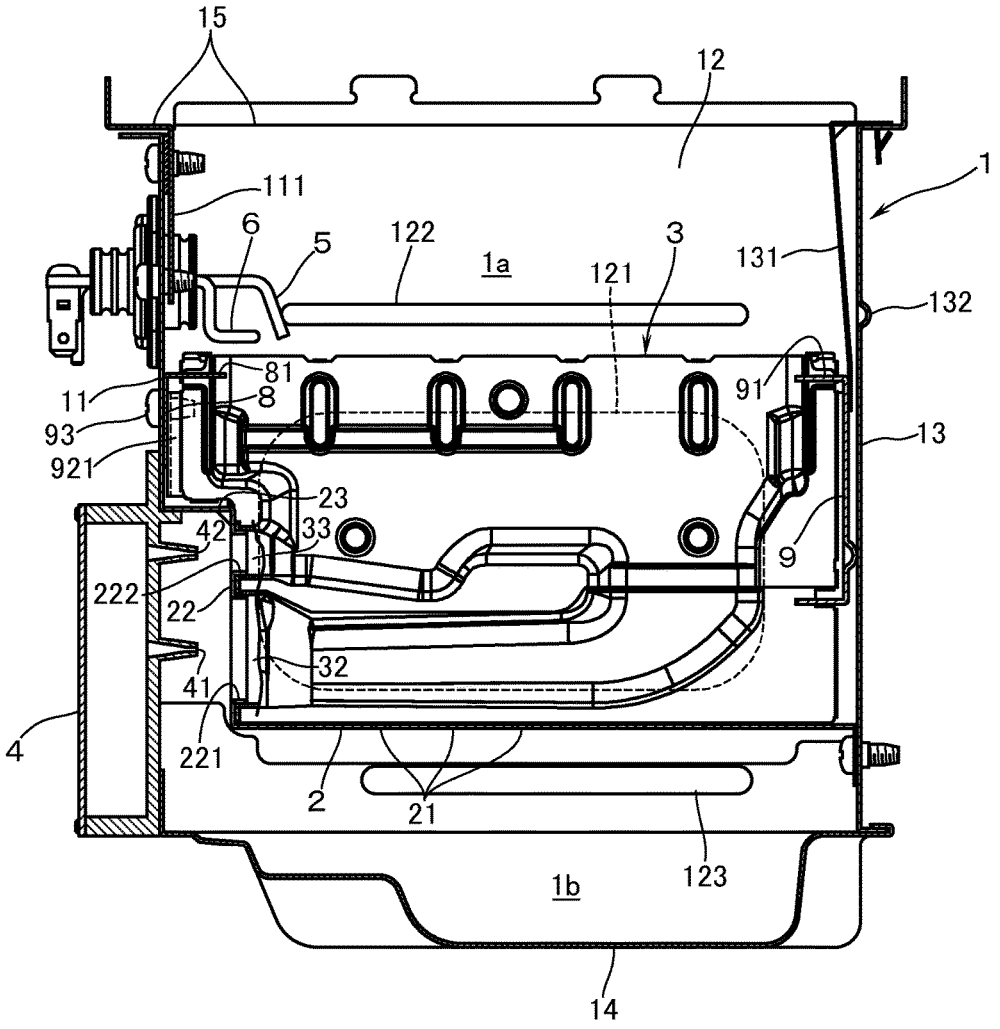
FIG. 3 is a sectional side view taken along the line III-III in FIG. 2.

With reference to FIGS. 1 to 4, a combustion apparatus according to an embodiment of this invention is provided with a combustion box 1. The combustion box 1 has: a front-plate part 11 on an upper part of a front surface; side-plate parts 12, 12 on both sides of the lateral direction; a back-plate part 13; and a bottom-plate part 14. An upper end of the combustion box 1 further has a connection flange part 15 for connecting thereto a heat exchanger (not illustrated) for supplying hot water and the like. Inside the combustion box 1 there is provided a partition plate 2 for partitioning the space inside the combustion box 1 into a combustion chamber 1*a* and an air supply chamber 1*b* which lies under the combustion chamber 1*a*. To a bottom surface of the air supply chamber 1*b*, i.e., to the bottom-plate part 14, there is connected a fan (not illustrated). It is thus so arranged that air from the air supply chamber 1*b* can be supplied to the combustion chamber 1*a* through a multiplicity of distribution holes 21 that are formed in the partition plate 2.

Figure 5:
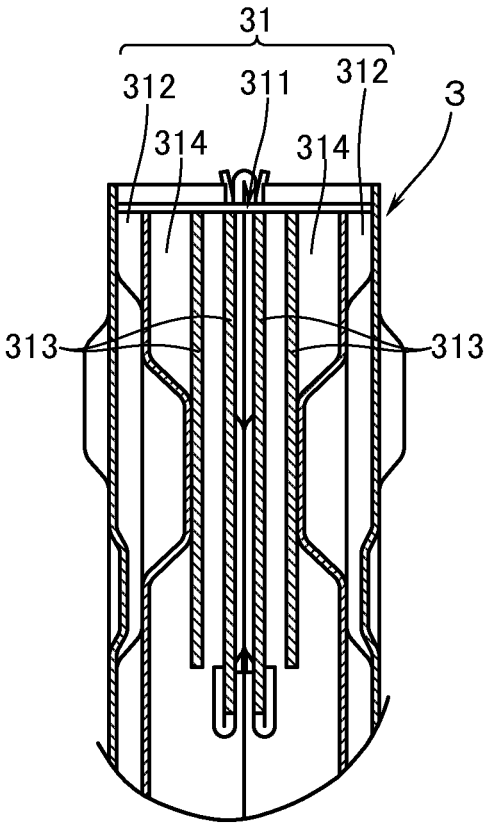
FIG. 5 is a sectional view of a flame hole portion of the burner.

The combustion chamber 1*a* contains therein a plurality of burners 3 that are longitudinally elongated and laterally arrayed, with flame holes 31 on each upper end of the burners 3. As shown in FIG. 5, each of the flame holes 31 is constituted by: a thin flame hole 311 for ejecting thin air-fuel mixture whose fuel concentration is thinner than the theoretical air-fuel ratio; and a pair of thick flame holes 312, 312, located on laterally both outsides of the thin flame holes 311. The thick flame holes are for ejecting thick air-fuel mixture whose fuel concentration is thicker than the thin air-fuel mixture. Inside the thin flame holes 311, there are mounted a plurality of straightening plates 313 at a lateral distance from one another. Still furthermore, on both sides of the respective thin flame holes 311, recirculation regions 314 through which no air-fuel mixture is ejected are disposed. The front end at the burner lower portion is provided with: first flow inlets 32 which are in communication with the thin flame holes 311; and second flow inlets 33 which are in communication with the thick flame holes 312.

In addition, the front end of the partition plate 2 is provided with: a riser plate part 22 which extends upward; and an upper plate part 23 which is bent forward from the upper end of the riser plate part 22, finally reaching the front-plate part 11 of the combustion box 1. In this embodiment, the front end of the upper-plate part 23 is bent upward so as to integrally form the front-plate part 11. The riser plate part 22 has formed therein openings 221, 222 which respectively coincide with the first and the second flow inlets 32, 33 of each of the burners 3. Toward the front of the riser plate part 22 there is mounted a manifold 4 in a manner to close the lower front surface of the combustion box 1. The manifold 4 is provided with first and second gas nozzles 41, 42 which lie opposite to the first and second flow inlets 32, 33 of each of the burners 3. It is thus so arranged that fuel gas is supplied from each of the first and second gas nozzles 41, 42 to each of the first and second flow inlets 32, 33, and also that primary air is supplied from the air supply chamber 1*b*, through a clearance to be defined between the riser plate part 22 and the manifold 4, to each of the flow inlets 32, 33, respectively. In FIG. 1 the manifold 4 is omitted.

The front-plate part 11 of the combustion box 1 has disposed therein an ignition electrode 5, a flame rod 6, and a peep window 7. Inside the combustion box 1 there are disposed a positioning frame 8 on the front side and a positioning frame 9 on the back side. On an upper end of each of the positioning frames 8, 9 there are disposed, in a bent manner, a plurality of claw pieces 81, 91 which are inserted into the clearance between each of the front and back ends of each of the burners 3. By means of these claw pieces 81, 91 each of the burners 3 is laterally fixed in position. Further, on laterally both sides of the positioning frame 9 on the back side, a pair of side-plate parts 92, 92 are formed by bending in a manner to sandwich the burner disposing portion from laterally both sides. By the way, the positioning frame 9 on the back side is fixed with screws 93 to the front-plate part 11 at the front end part 921 of each of the side-plate parts 92, and is also fixed with screws 94 to the partition plate 2 at tongue parts 922 extended to the back-side lower end of each of the side-plate parts 92. Further, on an inside of the front-plate part 11 and the back-plate part 13 of the combustion box 1, shield plates 111, 131 are disposed.

Now, according to this embodiment, a drawn part 121 is provided in a position, above the partition plate 2, of the side-plate part 12 on each lateral side of the combustion box 1 such that the drawn part 121 is projecting laterally outward of the combustion box 1 over a predetermined range in the vertical and longitudinal directions. By disposing the drawn part 121 in the manner mentioned above, the internal volume of the combustion box 1 will increase by the amount corresponding to the drawn parts 121. According to this arrangement, Helmholtz type frequency becomes lower than the frequency of the combustion vibrations, whereby the occurrence of the resonance sound is restrained.

In addition, according to this embodiment, unlike an example in which the internal volume of the combustion box 1 is increased by increasing the height dimension of the combustion box 1, there will be no disadvantage in that the distance between the heat exchanger and the burners 3 increases so that the thermal efficiency is lowered. Furthermore, unlike the example in which the internal volume of the entire combustion box 1 is increased by increasing the lateral dimension or the longitudinal dimension of the entire combustion box 1, the dimensions of the connection flange 15 do not change. Therefore, there is no need of replacing the heat exchanger.

By the way, in case the lower side of the drawn part 121 is positioned below the partition plate 2, it becomes necessary to make the lateral width of the partition plate 2 larger by an amount (a size) equivalent to the lateral projection of the drawn part 121. The above-mentioned arrangement is necessary to cause the side edges of the partition plate 2 to come into contact with the internal surfaces of the drawn part 121. However, should such an arrangement be employed, the lateral width of the partition plate 2 will become larger than the lateral width of that portion of the combustion box 1 which lies on a front side or upper side relative to the drawn part 121. As a result, such a partition plate 2 will never be able to be mounted in position inside the combustion box 1. According to this embodiment, on the other hand, since the lower end of the drawn part 121 is positioned above the partition plate 2, the lateral width of the partition plate 2 can be adjusted to the lateral width of that portion of the combustion box 1 which lies on the front side or upper side relative to the drawn part 121. There will thus be no problem in the mounting of the partition plate 2 inside the combustion box 1.

Figure 4:
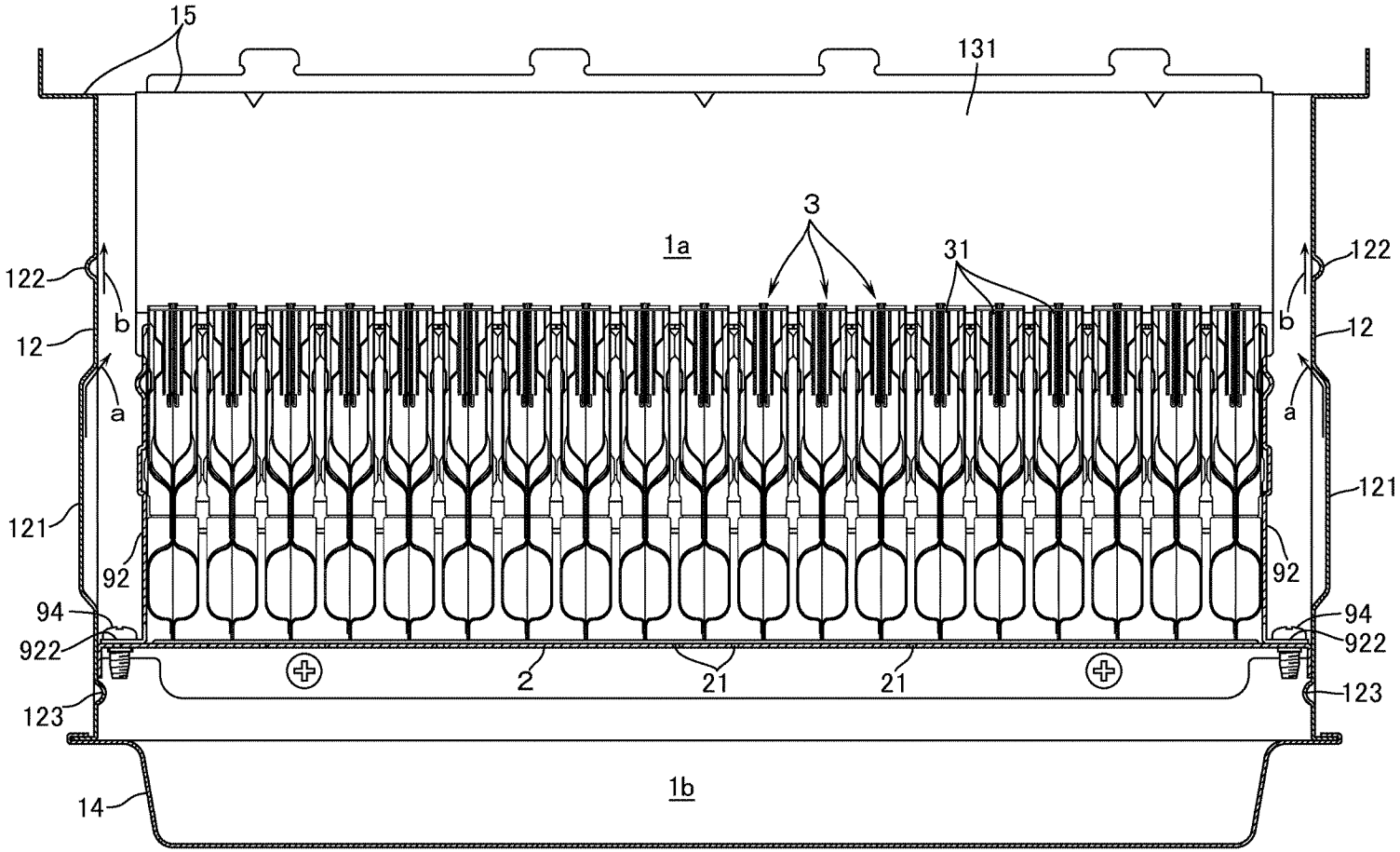
FIG. 4 is a sectional front view taken along the line IV-IV in FIG. 2.

By the way, it is necessary to cool the side-plate part 12 of the combustion box 1 by the air that flows upward along the internal surface of the side-plate part 12, in order to prevent the side-plate part 12 from getting overheated. However, along the upper side of the drawn part 121, as shown in FIG. 4 by an arrow "a", a direction component to be directed toward the laterally inward direction will be added to the air that has flown upward along the internal surface of the drawn part 121. Therefore, at the side-plate part in the neighborhood of the upper side of the drawn part 121, the air flow will be departed away from the internal surface of the side-plate part 12, and the cooling capacity of the side-plate part 12 by the air flow will be lowered. And if the upper side of the drawn part 121 is positioned above the upper end of the burner 3, that side-plate part in the neighborhood of the upper side of the drawn part 121 which is lowered in the capacity of cooling by the air flow will come to receive heat from the flames to be generated on the flame holes 31 of the burner 3. As a result, this side-plate part is likely to get overheated.

As a solution, in this embodiment, the upper side of the drawn part 121 is arranged to be lower than the upper end of the burners 3. According to this arrangement, that side-plate part in the neighborhood of the upper side of the drawn part 121 which is lowered in the capacity of cooling by the air flow, ceases to receive much heat from the flames, thereby restraining this side-plate part from getting overheated.

Alternatively, it may also be possible to incline the upper side of the drawn part 121 in the vertical direction. However, according to this arrangement, the distance between the flame hole 31 of the burner 3 that is adjacent to the side-plate part 12, i.e., the laterally outermost burner 3 and the upper side of the drawn part 121 varies with the front part and the back part of the burner 3. As a consequence, the manner of flow of the secondary air that is directed from the upper side of the drawn part 121 toward the flame of the outermost burner 3 varies with the front part and the back part of the burner 3, thereby giving rise to non-uniformity in combustion.

Therefore, in this embodiment the upper side of the drawn part 121 is arranged to be in parallel with the upper end of the burner 3, i.e., to be horizontal in a front-to-back direction. According to this arrangement, the manner of flowing of the secondary air from the upper end of the drawn part 121 toward the flame of the outermost burner 3 becomes uniform over the entire length of the burner, thereby preventing the occurrence of the non-uniformity in combustion.

By the way, in this embodiment in a position above the upper end of the burner 3, the side-plate part 12 has respectively formed therein a reinforcing bead 122 that protrudes laterally outward in a manner to be elongated linearly in the front-to-back direction. Since each of these reinforcing beads 122 has a narrow vertical width, the air to flow from below the reinforcing bead 122 in the vertical direction along the internal surface of the side-plate part 12 will flow directly upward, as shown by an arrow b in FIG. 4, without going into the inside of the reinforcing bead 122. Accordingly, there will occur no shortage in cooling at the side-plate part above the reinforcing bead 122. Further, in such a portion of the side-plate part 12 as is below the partition plate 2, there is respectively formed a laterally and inwardly dented reinforcing bead 123 in a manner to be extended linearly in the front-to-back direction. Also, at such a portion of the back-plate part 13 as is above the upper end of the burner 3, there is formed a backward-projecting reinforcing bead 132 which extends linearly in the lateral direction.

Description has so far been made of an embodiment of this invention. This invention shall, however, be not limited to the above. For example, in the above-mentioned embodiment, the burner 3 is constituted by a so-called thick and thin burner having thin flame holes 311 and thick flame holes 312, but the burner 3 may be constituted by an ordinary Bunsen burner in which thick flame holes 312 are omitted.

EXPLANATION OF MARKS

| | | | |
|---|---|---|---|
| 1 | combustion box | 1a | combustion chamber |
| 1b | air supply chamber | 12 | side-plate part |
| 121 | drawn part | 15 | connection flange part |
| 2 | partition plate | 21 | distribution hole |
| 3 | burner | 31 | flame hole |

What is claimed is:

1. A combustion apparatus comprising:

a combustion box having, on an upper end thereof, a connection flange part for connecting thereto a heat exchanger;

a partition plate inside the combustion box in order to partition space therein into a combustion chamber and an air supply chamber which lies under the combustion chamber;

a plurality of burners which are laterally arrayed in the combustion chamber, each of the burners being longitudinally elongated with flame holes on an upper end thereof such that air can be supplied from the air supply chamber to the combustion chamber through a multiplicity of distribution holes formed in the partition plate;

wherein a drawn part is disposed in a portion, above the partition plate, of a side-plate part on each lateral side of the combustion box, the drawn part being projecting laterally outward of the side-plate part over a predetermined range in the vertical and longitudinal directions, and wherein the drawn part is set in size such that due to an increase in an internal volume of the combustion box by disposing the drawn part, Helmholtz type resonance frequency of the combustion apparatus becomes lower than frequency of combustion vibrations.

2. The combustion apparatus according to claim 1, wherein an upper side of the drawn part is positioned below the upper end of the burners.

3. The combustion apparatus according to claim 1, wherein an upper side of the drawn part is positioned in parallel with the upper end of the burners.

* * * * *